US007642912B2

(12) United States Patent
Sholem

(10) Patent No.: US 7,642,912 B2
(45) Date of Patent: Jan. 5, 2010

(54) REMOTE CONTROL HOLDER

(76) Inventor: Steven Sholem, 6121 N. 1st Ave., Phoenix, AZ (US) 85013

( * ) Notice: Subject to any disclaimer, the term of this patent is extended or adjusted under 35 U.S.C. 154(b) by 27 days.

(21) Appl. No.: 11/751,547

(22) Filed: May 21, 2007

(65) Prior Publication Data

US 2007/0279245 A1 Dec. 6, 2007

Related U.S. Application Data

(60) Provisional application No. 60/747,895, filed on May 22, 2006.

(51) Int. Cl.
*G08B 1/08* (2006.01)

(52) U.S. Cl. ..... 340/539.32; 340/7.1; 211/26.1

(58) Field of Classification Search ..... 340/539.32, 340/539.1, 539.15, 568.1, 825.36, 7.1; 211/26, 211/26.1
See application file for complete search history.

(56) References Cited

U.S. PATENT DOCUMENTS 4,852,746 A * 8/1989 Wells et al. ..... 211/26.1
5,316,249 A * 5/1994 Anderson ..... 248/146
5,341,941 A * 8/1994 Marlor ..... 211/26.1
5,605,235 A * 2/1997 Johnson ..... 211/26.1
5,872,702 A * 2/1999 Kopel ..... 361/810
6,279,753 B1 * 8/2001 Swanson ..... 211/13.1
6,320,503 B1 * 11/2001 Dunn et al. ..... 340/539.32
7,284,791 B1 * 10/2007 Wright ..... 297/188.18
2005/0168338 A1 * 8/2005 Parker et al. ..... 340/539.32
2006/0085940 A1 * 4/2006 Chernoff ..... 15/313
2006/0201895 A1 * 9/2006 Jackson ..... 211/13.1

* cited by examiner

*Primary Examiner*—Travis R Hunnings
(74) *Attorney, Agent, or Firm*—Schmeiser, Olsen & Watts LLP

(57) ABSTRACT

The remote control holder of the present invention includes one or more recesses for holding remote controls and one or more cup holders. The holder may also include a heating device and/or a cooling device coupled to the cup holder. The holder may also include a paging system with one or more paging buttons. Each of the paging buttons is associated with one of the recesses. Each paging button may be a different color. In addition, each paging button may be associated with a paging receiver attached to a remote control to be stored in the recess that is associated with the paging button. The method for using the remote control holder includes locating a remote control by depressing a paging button, thereby causing the associated paging receiver attached to the remote control to emit an audible alarm. The remote control may then be disposed within the recess associated with the paging button.

19 Claims, 3 Drawing Sheets

REMOTE CONTROL HOLDER

CROSS REFERENCE TO RELATED APPLICATION

This application claims priority to U.S. Provisional Patent Application to Steven Sholem entitled "REMOTE CONTROL HOLDER," Ser. No. 60/747,895, filed May 22, 2006, the disclosure of which is hereby incorporated entirely herein by reference.

BACKGROUND OF THE INVENTION

1. Technical Field

This invention relates generally to a remote control holder and more particularly to a remote control holder with a cup holder.

2. State of the Art

It is becoming more common that a typical home may have several remote controls in order to operate the various electronic devices used for entertainment. These electronic devices may include home theater systems, televisions, DVD players, CD players, stereos, surround sound systems, digital cable boxes, satellite television receivers and the like. Each device is often provided with a remote control to provide convenient modes of operating the device. While many devices can be consolidated onto a single universal remote control, certain devices cannot be controlled with the universal remote. Additionally, there are often functions of an electronic device that are not available while using the universal remote control.

Since various remote controls must be maintained in order to operate all of the electronic devices, there exists a problem with storing the remote controls while they are not in use. Conventional remote control holders include a pouch system that hangs over the arm of a chair or sofa and has pouches or pockets within which the remote controls are stored. These holders are limited not only in their abilities to store remotes, but further they are not visually pleasing and often detract from the décor of the room. Additionally, the conventional remote control holders lack the capability to aid in the location of a lost remote control and further do not provide other conveniences such as holding a cup.

Accordingly, there is a need in the field of remote control holders for an improved holder.

DISCLOSURE OF THE INVENTION

The present invention relates to a remote control holder for retaining at least one remote control, wherein the remote control holder includes a cup holder and a paging system for locating lost remote controls.

An aspect of the present invention includes a remote control holder comprising a manifold section, at least one recess within the manifold section, the at least one recess for holding a remote control, and a paging device integral to the manifold section.

Another aspect of the present invention includes a remote control holder comprising a manifold section, at least one recess within the manifold section, the at least one recess for holding a remote control, and a cup holder coupled to the manifold section.

Yet another aspect of the present invention includes a remote control holder comprising a manifold section, at least one recess within the manifold section, the at least one recess for holding a remote control, a cup holder coupled to the manifold section, and a paging device integral to the manifold section.

In other particular embodiments of the present invention, the cup holder may further include a heating device, wherein the heating device heats a hot drink placed within the cup holder. Additionally, the cup holder may include a cooling device for cooling a drink placed within the cup holder.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a remote control holder for retaining at least one remote control, wherein the remote control holder includes a cup holder and/or a paging system for locating lost remote controls.

Figure 1:
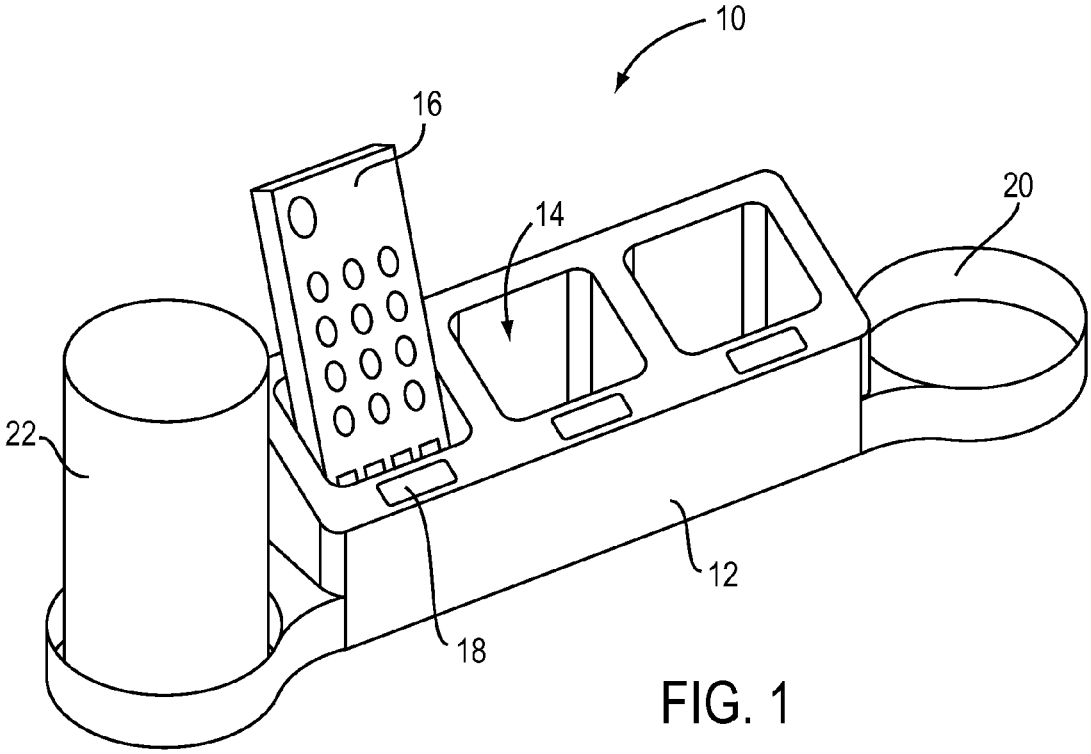
FIG. 1 is a perspective view of a remote control holder in accordance with the present invention.
Figure 2:
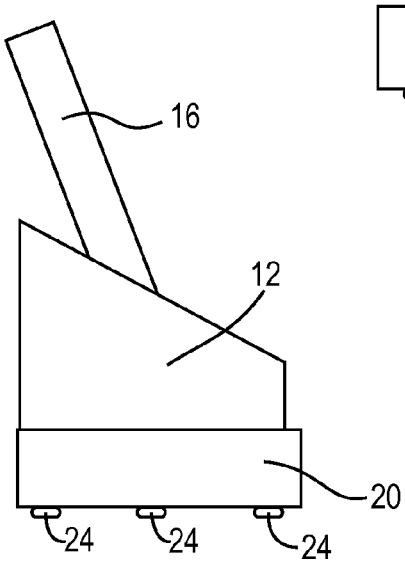
FIG. 2 is a side view of a remote control holder in accordance with the present invention.

As shown in FIGS. 1 and 2, particular embodiments of the present invention include a remote control holder 10. The remote control holder 10 comprises a manifold section 12 and at least one cup holder 20. The manifold section may comprise one or more recesses 14 for holding a remote control 16 in an upright position. The manifold section may further comprise a paging device integral to the manifold section 12, the paging device having a paging button 18. The at least one cup holder 20 is coupled to a side of the manifold section 12. In particular embodiments, bottom sides of each of the at least one cup holder 20 and the manifold section 12 are substantially within the same plane, so as to allow the remote control holder 10 to rest substantially even on a flat surface, such as an end table, a coffee table and the like.

The remote control holder 10 may further comprise non-slip pads 24. The non-slip pads 24 provide friction between the pads and the surface upon which the remote control holder 10 may be placed such that the remote control holder 10 is not easily slid on the surface. It will be understood that the non-slip pads 24 may be formed of rubber or any type of material that increases the friction and reduces the ability of the remote control holder 10 to slide on the surface upon which it is resting.

The remote control 16 may rest easily within the recess 14. The recess 14 may be of sufficient size to hold virtually all sizes of remote controls 16. The remote control 16 is held in a substantially up right position so that the remote control 16 is easily retrievable from within the recess 14.

The cup holder 20 may be of a size and shape to hold various types and sizes of cups 22, including, but not limited to, glasses, cups and mugs. The cup holder 20 allows a user to store his or her cup 22 on a coffee table, for example, without the worry of making adverse marks on the coffee table or other damage, such as, scratches, mars, water marks, burns and the like.

In particular embodiments of the present invention, the cup holder 20 may also provide heating and cooling capabilities. For example, the cup holder 20 may comprise a heating device, wherein heat is provided to the cup 22 to keep a hot drink heated. This allows the user flexibility in the time needed to consume the drink while it is hot. Other particular embodiments of the present invention include a cup holder 20 that may comprise a cooling device. The cooling device cools a cup and allows the drink to remain cold while it rests in the cup holder 20. It will be understood that while particular embodiments of the present invention provide a heating device while others provide a cooling device, particular embodiments may incorporate both a heating and a cooling device. Further, the user may select which device he or she would like to use prior to placing the cup 22 into the cup holder 20. It will further be understood that particular embodiments of the present invention may provide for various temperature settings, such as by use of a dial to select how hot or how cold the user would like the cup holder to be.

Figure 3A:
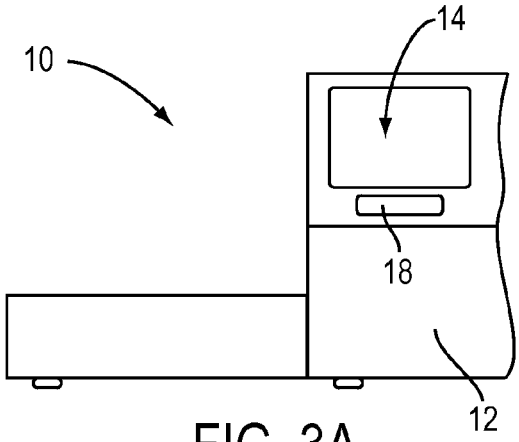
FIG. 3A is front view of a portion of a remote control holder in accordance with the present invention.
Figure 3B:
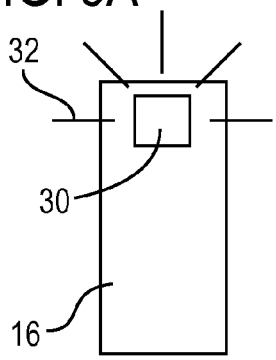
FIG. 3B is a rear view of a remote control in accordance with the present invention.

Referring further to the drawings, FIG. 3A depicts a remote control holder 10 in accordance with the present invention. The remote control holder 10 comprises a manifold section 12, wherein the manifold section 12 comprises a recess 14 for holding a remote control 16 and an integral paging device having a paging button 18. According to particular embodiments of the present invention, a paging receiver 30 may be coupled to a remote control 16, as depicted in FIG. 3B. If a user desires to locate a remote control 16 that is not placed within the remote control holder 10 and further find a remote control 16 that is lost, the user may simply press the associated paging button 18 and the paging receiver 30 begins to emit an audible alarm 32. The alarm 32 may sound until the remote control 16 is located. Once the remote control 16 is located, the alarm 32 may then be manually turned off in various ways, such as, but not limited to, depressing the paging button 18 again, pressing a button on the paging receiver 30 or any other manual means of turning off the alarm 32.

It will be understood that particular embodiments of the present invention may include a remote control holder 10 that has a plurality of recesses 14 to hold a plurality of remote controls 16, and a plurality of paging buttons 18, each paging button 18 associated with one recess 14 of the plurality of recesses 14. The plurality of paging buttons 18 allows a user to incorporate the paging feature of the present invention on multiple remote controls 16. Each paging button 18 is associated with a unique receiver 30. The receiver 30 may be placed onto the remote 16 which is stored in the associated recess 14. The user may also label the button 18 to better determine which remote control 16 is lost or misplaced and allow the user to designate which paging button 18 to press to sound the associated alarm 32. In a particular embodiment, each paging button 18 may alternatively or additionally be associated with a different color and each receiver 30 may correspond to the color that is associated the respective paging button 18. For example, if the first paging button is red, then the first remote control includes a receiver that is red. The first paging button is associated with a first recess that is adapted for holding the first remote control.

It will be understood by those of ordinary skill in the art that various types of paging devices may be employed. For example, a paging device may use RF signals to transmit to the receiver, wherein each button 18 is configured to send a unique signal corresponding to a single receiver 30. Other paging devices may use other wireless communications, such as, but not limited to Bluetooth and wi-fi.

Figure 4:
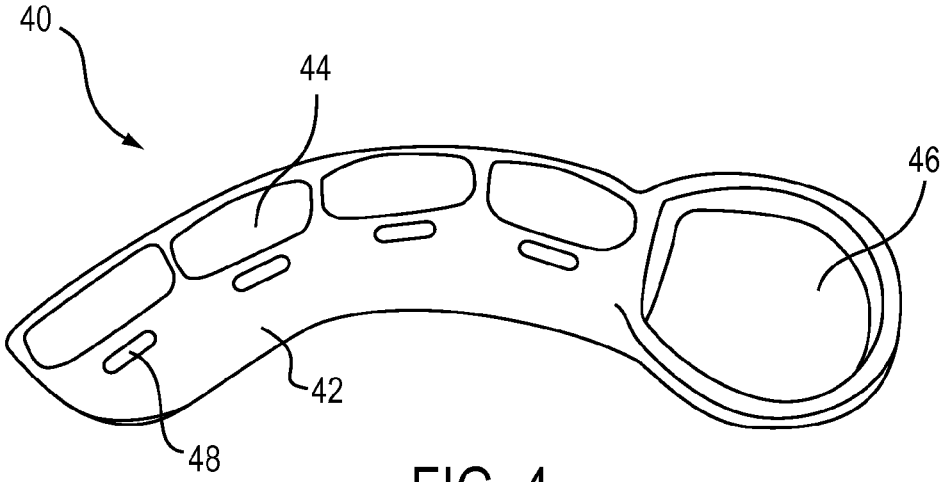
FIG. 4 is a top view of a remote control holder in accordance with another embodiment of the present invention.
Figure 5:
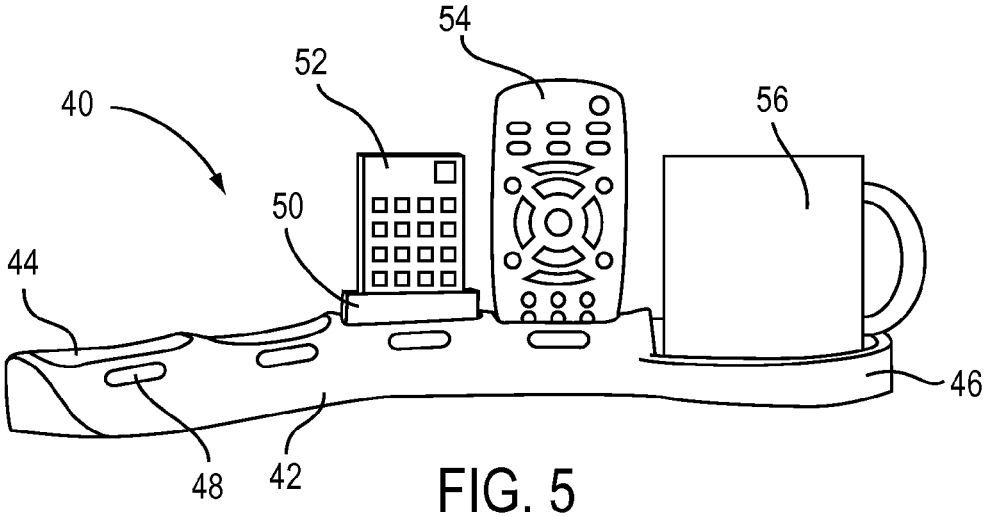
FIG. 5 is a front view of a remote control holder in accordance with another embodiment of the present invention.

Referring further to the drawings, FIGS. 4 and 5 depict another embodiment of a remote control holder 40 in accordance with the present invention. The remote control holder 40 comprises a manifold section 42, recesses 44 for holding remote controls 52, 54 and a paging device integral to the manifold section 42, the paging device having a paging button 48. The remote control holder 40 may further comprise a cup holder 46 coupled to the manifold section 42. Bottom sides of the manifold section 42 and the cup holder 46 may be substantially within the same plane, such that the remote control holder 40 rests substantially level on a flat surface such as a table.

The paging device functions in a similar manner as that previously disclosed, wherein the paging button 48 is depressed to allow a receiver coupled to a remote control to sound an alarm, thereby providing greater ease in locating the remote control. Additionally, the recesses 44 may be of a size and shape so as to hold various sized remote controls. The remote control holder 40 may be formed in any shape, size and color so as to correspond to the particular décor of the room within which the remote control holder 40 is placed.

The cup holder 46 may be integral to the manifold section 42. While particular embodiments show that the cup holder is integral to the manifold section, other particular embodiments may utilize a cup holder that is removably securable to the manifold section of the remote control holder. The cup holder 46 may be of a size and shape so as to accommodate and hold any type of cup 56.

The remote control holder 40 may also include insert 50. Insert 50 provides a smaller recess within the insert to allow various shaped and sized remote controls, such as remote control 52, to be retained in a substantially vertical position. The insert 50 is particularly useful for remote controls having a size smaller than that recess 44. The insert 50 may be removable from within the recess 44.

Figure 7:
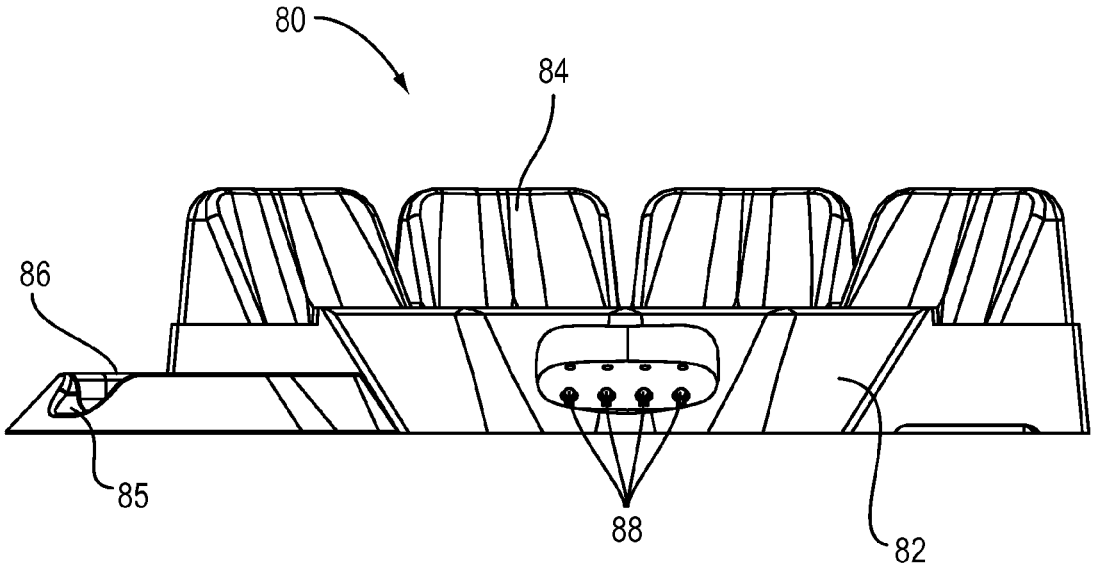
FIG. 7 is a front elevation view of a remote control holder in accordance with another embodiment of the present invention.
Figure 8:
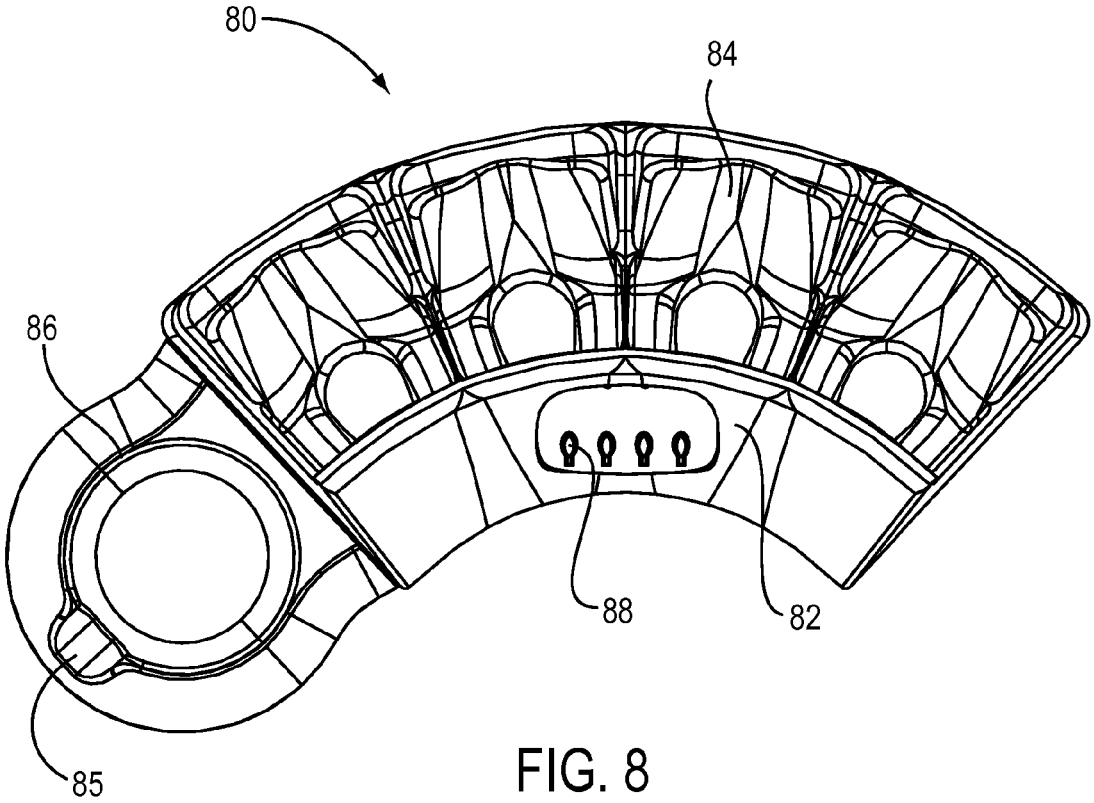
FIG. 8 is a top plan view of a remote control holder in accordance with another embodiment of the present invention.

Another embodiment of the remote control holder 80 in accordance with the present invention is shown in FIGS. 7 and 8. The remote control holder 80 comprises a manifold section 82 and the manifold section 82 includes a plurality of recesses 84 for holding remote controls. The recesses 84 may be of sufficient size and shape to hold a remote control of substantially any size. The manifold section 82 further includes a paging system that includes a plurality of paging buttons 88. The number of paging buttons 88 is equal to the number of recesses 84. The embodiment depicted in FIGS. 7 and 8 includes four recesses 84 and four paging buttons 88. However, it should be noted that the embodiment depicted in FIGS. 7 and 8 is for illustrative purposes only and is not intended to be limited to four recesses 84 and paging buttons 88. The remote control holder 80 may have any desired number of recesses and paging buttons 88. The location of each paging button 88 corresponds to the location of a recess 84. For example, the leftmost paging button 88 corresponds to the leftmost recess 84, the rightmost paging button 88 corresponds to the rightmost recess 84, and so forth. As discussed above, the remote controls to be disposed in the recesses 84 of the remote control holder 80 each include a paging receiver attached thereto. Each paging receiver is associated with a paging button 88, where the paging button 88 corresponds to the recess 84 in which the remote control is to be stored. Each paging button 88 may include a label that indicates which of the remote controls is associated with that paging button 88. In a particular embodiment, each of the paging buttons 88 is a different color and each of the paging receivers is a different color, where the color of the paging receiver is the same as the color of the corresponding paging button.

The remote control holder 80 further includes a cup holder 86. In the embodiment depicted in FIGS. 7 and 8, the cup holder 86 is positioned on the left side of the holder 80. However, it should be noted that the cup holder 86 may by positioned on the right side of the holder 80 or the holder 80 may include two cup holders, similar to the embodiment of FIGS. 1-3. Bottom sides of the manifold section 82 and the cup holder 86 may be substantially within the same plane, such that the remote control holder 80 rests substantially level on a flat surface such as a table. The cup holder 86 may be repeatably removable such that the cup holder 86 may be detached and re-attached to the manifold section 82. Similarly, the cup holder 86 may be re-positioned to the opposite side of the manifold section 82. The cup holder 86 may include a groove 85 for facilitating the handle of a mug.

Figure 6A:
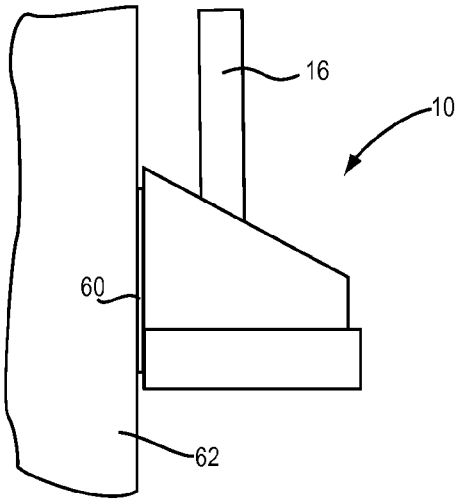
FIG. 6A is a side view of a remote control holder mounted to a wall in accordance with the present invention.

Referring further to the drawings, FIG. 6A depicts a side view of a remote control holder 10 coupled to a wall 62 in accordance with embodiments of the present invention. A plate 60 may be mounted to the wall 62 and the remote control holder 10 may further be mounted to the plate 60. The remote control holder 10 will then be retained in the position adjacent to the wall 62 and allows access to and storage of remote control 16. The plate 60 may be formed of various materials, including, but not limited to metal, plastic, composites, and synthetic materials. The plate 60 may be mounted to the wall 62 in various ways, including, without limitation, a bolt, a screw, an adhesive, an adhesive tape, hook-and-loop fasteners, a hook, a clip and the like. The remote control holder 10 may be coupled to the plate 60 using any attachment means including, but not limited to, a magnet, a bolt, a screw, an adhesive, an adhesive tape, hook-and-loop fasteners, a hook, a clip, a clasp and the like.

Figure 6B:
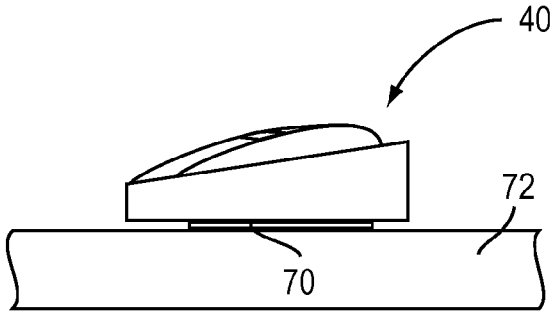
FIG. 6B is a side view of a remote control holder mounted to a table in accordance with the present invention.

Referring again to the drawings, FIG. 6B depicts a side view of a remote control holder 40 mounted to a table 72. A plate 70 may be mounted to the table 72 and the remote control holder 40 may further be mounted to the plate 70. The remote control holder 40 will thus be retained in the position resting on the table 72 that allows access to and storage of remote controls. The plate 70 may be formed of various materials, including, but not limited to metal, plastic, composites, and synthetic materials. The plate 70 may be mounted to the table 72 in various ways, including, without limitation, a bolt, a screw, an adhesive, an adhesive tape, hook-and-loop fasteners, a hook, a clip and the like. The remote control holder 40 may be coupled to the plate 70 in various ways, including, but not limited to, a magnet, a bolt, a screw, an adhesive, an adhesive tape, hook-and-loop fasteners, a hook, a clip, a clasp and the like.

The components defining any remote control holder in accordance with the present invention may be formed of any of many different types of materials or combinations thereof that can readily be formed into shaped objects provided that the components selected are consistent with the intended operation of a remote control holder. For example, the components may be formed of: rubbers (synthetic and/or natural) and/or other like materials; glasses (such as fiberglass) carbon-fiber, aramid-fiber, any combination thereof, and/or other like materials; ceramics; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any remote control holder in accordance with the present invention may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of this disclosure.

What is claimed is:

1. A remote control holder comprising:

a manifold section having a plurality of recesses and a plurality of paging buttons, wherein each of the paging buttons is associated with one of the recesses and each of the plurality of paging buttons is a different color; and at least one cup holder exterior of the manifold section and repeatably removably secured to the manifold section, wherein the at least one cup holder is repeatably removably secured to only one of a right or a left side of the manifold section, wherein the plurality of recesses are adapted for retaining a plurality of remote controls therein.

2. The remote control holder of claim 1, further comprising at least one of a heating device and a cooling device operatively coupled to the at least one cup holder.

3. A method of using a remote control holder, comprising:

disposing a first remote control in one of a plurality of recesses provided in the remote control holder;

removably securing a first cup holder to only one of a right side or a left side exterior of a manifold section of the remote control holder; and disposing a first beverage container in a first cup holder provided in the remote control holder.

4. The method according to claim 3, further comprising locating the first remote control before the step of disposing the first remote control in the one of the plurality of recesses.

5. The method according to claim 3, further comprising attaching the remote control holder to a plate mounted to a surface.

6. The method according to claim 4, wherein the step of locating the first remote control further comprises depressing a first paging button.

7. The method according to claim 6, wherein the step of locating the first remote control further comprises attaching a first paging receiver to the first remote control and wherein the step of depressing the first paging button causes the first paging receiver to emit an audible alarm.

8. The method according to claim 7, wherein the first paging button and the first paging receiver are a first color.

9. The method according to claim 8, further comprising disposing a second remote control in another one of the plurality of recesses.

10. The method according to claim 9, further comprising attaching a second paging receiver to the second remote control.

11. The method according to claim 10, further comprising depressing a second paging button to cause the second paging receiver to emit an audible alarm.

12. The method according to claim 11, wherein the second paging button and the second paging receiver are a second color.

13. A method of using a remote control holder system, comprising:

attaching a first paging receiver to a first remote control;

removably securing a first cup holder to only one of a right side or a left side exterior of a manifold section of the remote control holder; and activating a first alarm by depressing a first paging button disposed on a remote control holder, wherein the first alarm is associated with the first paging receiver, and wherein a position of the first paging button on the remote control holder corresponds to a position of a first recess disposed within the remote control holder.

14. The method of claim 13, further comprising disposing the first remote control within the first recess.

15. The method of claim 13, further comprising disposing a beverage container within a cup holder portion of the remote control holder.

16. The method of claim 15, further comprising one of heating the beverage container by operating a heating device coupled to the cup holder portion and cooling the beverage container by operating a cooling device coupled to the cup holder portion.

17. The method of claim 13, further comprising disposing a second remote control within a second recess in the remote control holder.

18. The remote control holder of claim 1, further comprising an insert, wherein the insert is removably coupled within one of the plurality of recesses to accommodate a smaller remote control.

19. The remote control holder of claim 1, wherein the at least one cup holder comprises a groove for facilitating a handle of a mug.

* * * * *